US011199796B2

(12) United States Patent
Doi

(10) Patent No.: US 11,199,796 B2
(45) Date of Patent: Dec. 14, 2021

(54) IMAGE FORMING APPARATUS, IMAGE FORMING METHOD, AND STORAGE MEDIUM FOR STORING PROGRAM

(71) Applicant: TOSHIBA TEC KABUSHIKI KAISHA, Tokyo (JP)

(72) Inventor: Yayoi Doi, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/142,422

(22) Filed: Jan. 6, 2021

(65) Prior Publication Data

US 2021/0263451 A1 Aug. 26, 2021

Related U.S. Application Data

(63) Continuation of application No. 16/796,654, filed on Feb. 20, 2020, now Pat. No. 10,901,350.

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053
See application file for complete search history.

(56) References Cited

U.S. PATENT DOCUMENTS

| | | | | |
|---|---|---|---|---|
| 10,429,780 | B1 | 10/2019 | Hasegawa | |
| 10,698,349 | B1 | 6/2020 | Katsumata | |
| 2015/0286174 | A1 | 10/2015 | Yamamoto et al. | |
| 2018/0004134 | A1* | 1/2018 | Nomura | G03G 15/2039 |
| 2019/0121267 | A1 | 4/2019 | Miyauchi et al. | |
| 2020/0166876 | A1* | 5/2020 | Yonekubo | G03G 15/2053 |
| 2020/0174409 | A1 | 6/2020 | Kataoka et al. | |
| 2021/0033999 | A1* | 2/2021 | Uekawa | G03G 15/2021 |

OTHER PUBLICATIONS

Notice of Allowance on U.S. Appl. No. 16/796,654 dated Sep. 21, 2020.
U.S. Office Action on U.S. Appl. No. 16/796,654 dated Jul. 14, 2020.

* cited by examiner

*Primary Examiner* — Sophia S Chen
(74) *Attorney, Agent, or Firm* — Foley & Lardner LLP

(57) ABSTRACT

An image forming apparatus includes an image forming device configured to form an image on a sheet, a first heater configured to generate heat to heat a first print region of the sheet, a second heater configured to generate heat to heat a second print region of the sheet, the second heater being adjacent the first heater in a main scanning direction, and a controller configured to control the first heater to generate heat and the second heater to not generate heat based on a distance in the main scanning direction from (a) an end of a region of the image that overlaps the second heater to (b) a boundary between the first heater and the second heater in a situation where the region overlaps the boundary.

20 Claims, 9 Drawing Sheets

IMAGE FORMING APPARATUS, IMAGE FORMING METHOD, AND STORAGE MEDIUM FOR STORING PROGRAM

CROSS-REFERENCE TO RELATED APPLICATION

This application is a continuation of U.S. patent application Ser. No. 16/796,654, filed Feb. 20, 2020, the entire contents of which are incorporated herein by reference.

FIELD

Embodiments described herein relate generally to an image forming apparatus, an image forming method, and a storage medium for storing a program.

BACKGROUND

An on-demand fixing method is proposed as one technique for reducing power consumption in an image forming apparatus. In such an on-demand fixing method, a conveyed sheet and a developer are heated by a heater through a film. In recent years, a configuration in which a plurality of heaters are arranged in the main scanning direction instead of a single heater has been adopted.

As described above, in the on-demand fixing method having a plurality of heaters, the plurality of heaters are individually controlled in accordance with the presence or absence of an image in a region corresponding to the heater. As the quantity of heaters increases, power saving performance can be improved. However, when the quantity of heaters increases, each heater is provided with electrodes and sensors, and thus the required area of a substrate and the required number of wirings increase. In addition, variations in performance are likely to occur among the plurality of heaters. As described above, when the quantity of heaters increases, the area of the substrate and the number of wirings increase, and variations in performance occur.

DETAILED DESCRIPTION

According to an embodiment, there is provided an image forming apparatus including a fixing device and a control unit. In the fixing device, a plurality of heating elements or heaters that individually generate heat are arranged in a main scanning direction. The control unit controls heat generation of a first heating element based on (a) a presence or absence of heat generation of a second heating element arranged adjacent to the first heating element and (b) a maximum distance. The maximum distance is a maximum distance from a first boundary to an end portion of an image region, in which an image is formed, in the main scanning direction in a first print region corresponding to the first heating element. The first boundary is a boundary between the first heating element and the second heating element.

Hereinafter, an image forming apparatus according to an embodiment will be described with reference to the drawings.

Figure 1:
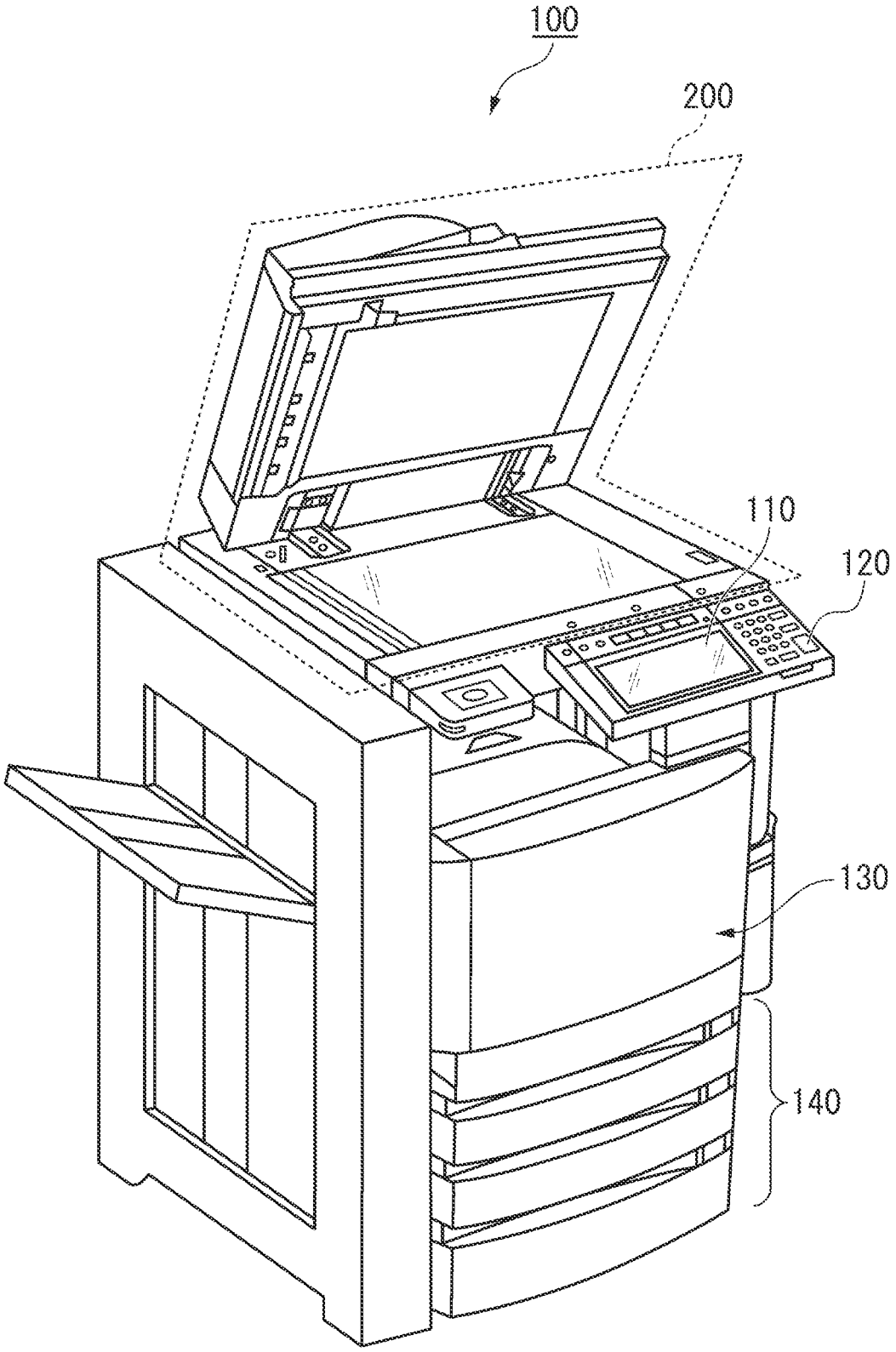
FIG. 1 is an external view showing an example of the overall configuration of an image forming apparatus according to an embodiment.

FIG. 1 is an external perspective view showing an example of the overall configuration of an image forming apparatus 100 according to an embodiment. The image forming apparatus 100 is, for example, a multifunction machine. The image forming apparatus 100 includes a display 110, a control panel 120, an image forming unit 130, a sheet storage unit 140, and an image reading unit 200.

The image forming apparatus 100 forms an image on a sheet using a developer. The developer is fixed on the sheet by being heated. The sheet is, for example, paper or label paper. The sheet may be any material as long as the image forming apparatus 100 can form an image on the surface thereof.

The display 110 is an image display device such as a liquid crystal display or an organic electro luminescence (EL) display. The display 110 displays various information regarding the image forming apparatus 100.

The control panel 120 includes a plurality of buttons. The control panel 120 receives an operation from a user. The control panel 120 outputs a signal corresponding to the operation performed by the user to a system control unit (system controller) 160 of the image forming apparatus 100. The system control unit 160 will be described with reference to FIG. 5. The display 110 and the control panel 120 may be configured as an integrated touch panel.

The image forming unit 130 forms an image on a sheet based on image information (e.g., image data). The image data may be generated by the image reading unit 200. Alternatively, the image data may be received as a print job from an external device via a network. The external device is, for example, a personal computer (PC), a facsimile (FAX), or the like.

Although described later in FIG. 5, the image forming unit 130 includes, for example, a developing unit 10, a transfer unit 20, and a fixing unit (e.g., a fixing device) 30. The configuration of the fixing unit 30 will be described later according to FIG. 2.

The image forming unit 130 forms an image by the following process, for example. The developing unit 10 of the image forming unit 130 forms an electrostatic latent image on a photosensitive drum based on the image data. The developing unit 10 of the image forming unit 130 forms a visible image by attaching a developer to the electrostatic latent image. Examples of the developer include a decoloring developer, a non-decoloring developer (e.g., an ordinary developer), and a decorative developer. Some developers lose color (e.g., at least partially disappear) when heated.

The transfer unit 20 of the image forming unit 130 transfers the visible image onto the sheet. The fixing unit 30 of the image forming unit 130 fixes the visible image on the sheet by heating and pressing the sheet. The sheet on which the image is formed may be a sheet stored in the sheet storage unit 140 or a manually inserted sheet.

The sheet storage unit 140 stores one or more sheets used for image formation in the image forming unit 130.

The image reading unit 200 reads information on an original document as light contrast, and generates and records the image data. The image data may be transmitted to another information processing apparatus via a network. The recorded image data may be used to form an image on the sheet by the image forming unit 130. The image reading unit 200 may include an auto document feeder (ADF).

Figure 2:
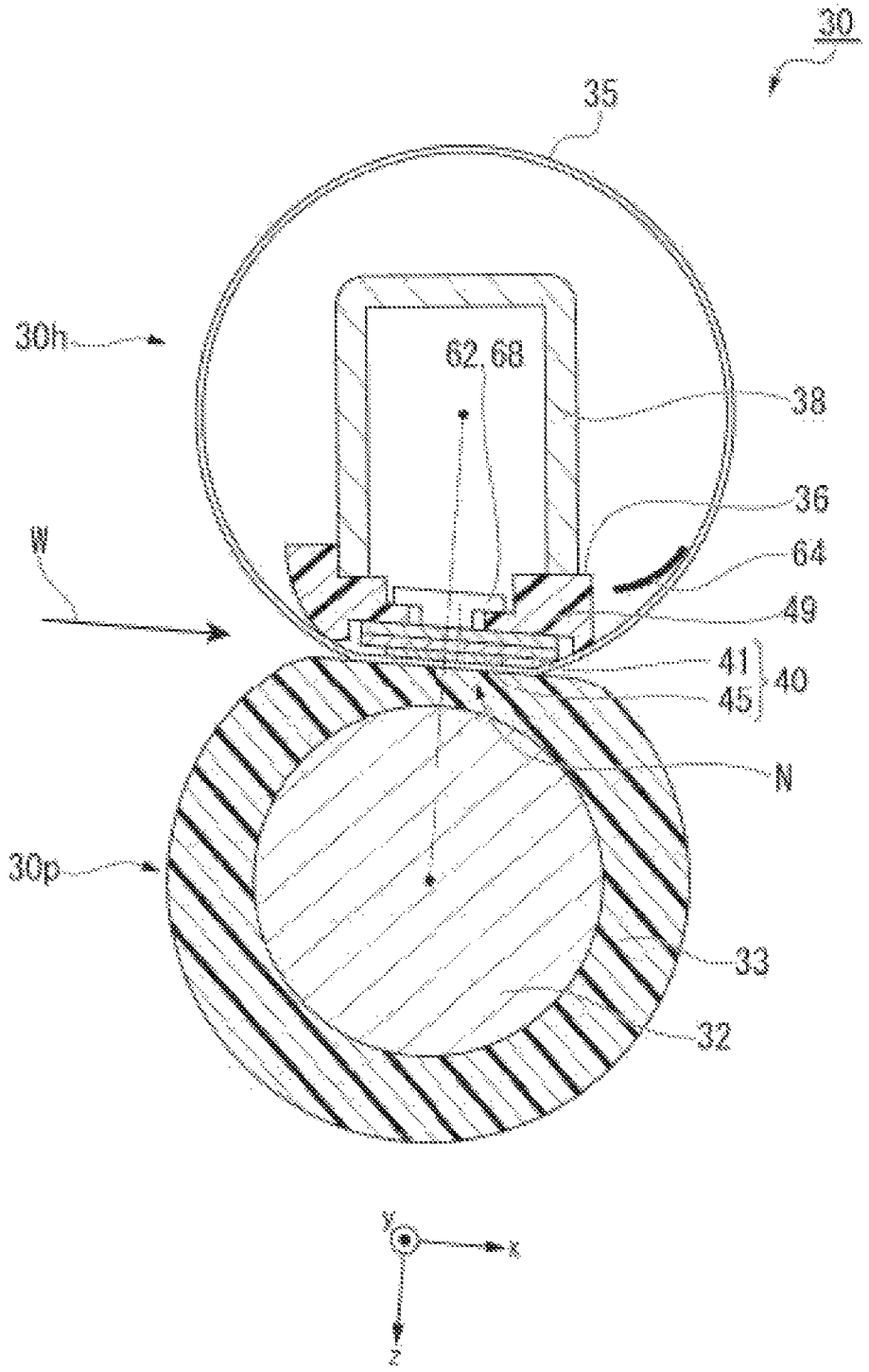
FIG. 2 is a front cross-sectional view of a fixing unit of the image forming apparatus of FIG. 1.

FIG. 2 is a front cross-sectional view of the fixing unit 30 of the embodiment. The fixing unit 30 of the embodiment includes a pressure roller 30*p* and a film unit 30*h*.

A surface of the pressure roller 30*p* can press against the film unit 30*h* and can be driven to be rotated. The pressure roller 30*p* forms a nip N with the film unit 30*h* when the surface is pressed against the film unit 30*h*. The pressure roller 30*p* presses the visible image on a sheet that enters the nip N. When the pressure roller 30*p* is driven to be rotated, the pressure roller conveys the sheet along the direction of rotation. The pressure roller 30*p* includes, for example, a metal core 32, an elastic layer 33, and a release layer (not shown).

The metal core 32 is formed in a cylindrical shape using a metal material such as stainless steel. Both end portions of the metal core 32 in the axial direction are rotatably supported. The metal core 32 is rotationally driven by a motor (not shown). The metal core 32 abuts on a cam member (not shown).

The elastic layer 33 is formed of an elastic material such as silicone rubber. The elastic layer 33 is formed on the outer peripheral surface of the metal core 32 and may have a constant thickness. A release layer (not shown) is formed on the outer peripheral surface of the elastic layer 33. The release layer is formed of a resin material such as a tetrafluoroethylene perfluoroalkyl vinyl ether copolymer (PFA).

The pressure roller 30*p* is rotated by a motor and rotates. When the pressure roller 30*p* rotates in a state in which the nip N is formed, a cylindrical film (e.g., a thin film) 35 of the film unit 30*h* is driven to be rotated. The pressure roller 30*p* conveys the sheet in the conveyance direction W by rotating in a state in which the sheet is arranged in the nip N.

The film unit 30*h* heats the visible image of the sheet that entered the nip N. The film unit 30*h* includes the cylindrical film 35 (i.e., a cylindrical body), a heater unit 40, a heat transfer member 49, a support member 36, and a stay 38. The film unit 30*h* further includes a heater thermometer 62, a thermostat 68, and a film thermometer 64.

The cylindrical film 35 is formed in a cylindrical shape. The cylindrical film 35 includes a base layer, an elastic layer, and a release layer in order from the inner peripheral side. The base layer is formed in a cylindrical shape using a material such as nickel (Ni). The elastic layer is arranged to be laminated on the outer peripheral surface of the base layer. The elastic layer is formed of an elastic material such as silicone rubber. The release layer is arranged to be laminated on the outer peripheral surface of the elastic layer. The release layer is formed of a material such as PFA resin.

Figure 3:
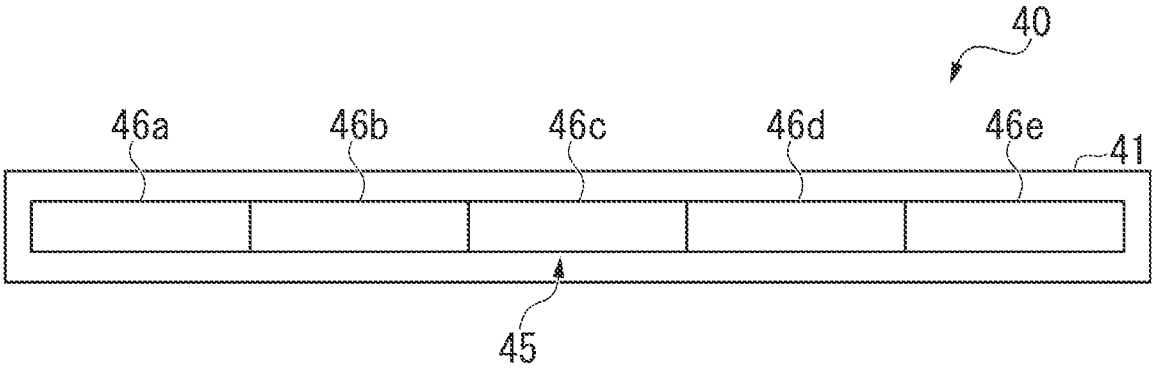
FIG. 3 is a schematic view of a heater unit of the fixing unit of FIG. 2.

FIG. 3 is a schematic view of the heater unit 40. The heater unit 40 includes a substrate (e.g., a heating element substrate) 41 and a heating element set 45. The substrate 41 is formed of, for example, a metal material such as stainless steel or nickel, or a ceramic material such as aluminum nitride. The substrate 41 is formed in a long and thin rectangular plate shape. The substrate 41 is arranged inside the cylindrical film 35 in the radial direction. The substrate 41 has the axial direction of the cylindrical film 35 as the longitudinal direction.

The heating element set 45 is formed on the surface of the substrate 41. The heating element set 45 includes a plurality of heating elements 46 (heaters). Each heating element 46 is formed using a heating resistor such as a silver palladium alloy. In the example of FIG. 3, the heating element set 45 includes five heating elements 46 (46*a* to 46*e*) (e.g., a first heating element or heater 46*a*, a second heating element or heater 46*b*, a third heating element or heater 46*c*, a fourth heating element or heater 46*d*, a fifth heating element or heater 46*e*). The heat generation amount of each heating element 46 is independently controlled by the system control unit 160 of FIG. 5.

As shown in FIG. 2, the heater unit 40 is arranged inside the cylindrical film 35. A lubricant (not shown) is applied to the inner peripheral surface of the cylindrical film 35. The heater unit 40 contacts the inner peripheral surface of the cylindrical film 35 via the lubricant. When the heater unit 40 generates heat, the viscosity of the lubricant decreases. Thus, the slidability of the heater unit 40 and the cylindrical film 35 is ensured. As described above, the cylindrical film 35 is a strip-shaped thin film that slides on the surface of the heater unit 40 while contacting the heater unit 40 on one surface.

The support member 36 is formed of a resin material such as a liquid crystal polymer. The support member 36 supports the heater unit 40. The support member 36 supports the inner peripheral surface of the cylindrical film 35 at both end portions of the heater unit 40.

The stay 38 is formed of a steel plate material or the like. The cross section of the stay 38 may be formed in a U shape, for example. The stay 38 is mounted so as to close a U-shaped opening with the support member 36. Both end portions of the stay 38 are fixed to the housing of the image forming apparatus 100. Accordingly, the film unit 30*h* is supported by the image forming apparatus 100.

The heater thermometer 62 is arranged in the vicinity of the heater unit 40. The heater thermometer 62 measures the temperature of the heater unit 40. The thermostat 68 is arranged in the same manner as the heater thermometer 62. The thermostat 68 cuts off the power supply to the heating element set 45 when the measured temperature of the heater unit 40 exceeds a predetermined temperature.

Figure 4:
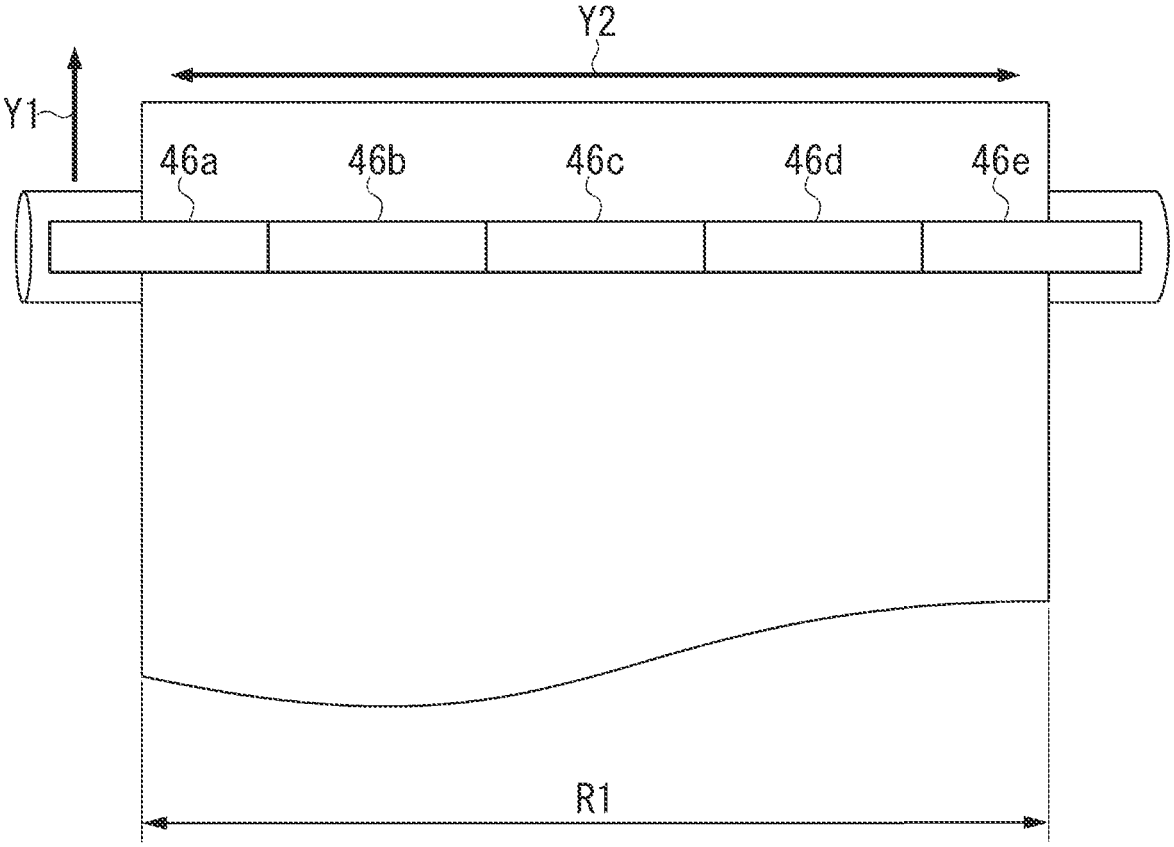
FIG. 4 is a view showing an example of a positional relationship between the heater unit of FIG. 3 and a sheet.

FIG. 4 is a view showing an example of a positional relationship between the heater unit 40 and the sheet. An arrow Y1 shown in FIG. 4 is the sheet conveyance direction (i.e., a paper passing direction). An arrow Y2 is a direction which is perpendicular to the conveyance direction and indicates the main scanning direction. The five heating elements 46*a* to 46*e* provided in the fixing unit 30 are arranged along the main scanning direction. A region R1 is a sheet passing region that indicates a range in the width direction of a sheet that is passed through in the image forming apparatus 100. The heating element set 45 is provided so that the length in the main scanning direction is larger than in the sheet passing region.

According to the example in FIG. 4, the lengths of the respective heating elements 46*a* to 46*e* in the main scanning direction are equal. However, the lengths of the respective heating elements 46*a* to 46*e* are not necessarily equal. For example, the heating elements 46*b* to 46*d* near the center may be longer than the heating elements 46*a* and 46*e* at the ends.

Figure 5:
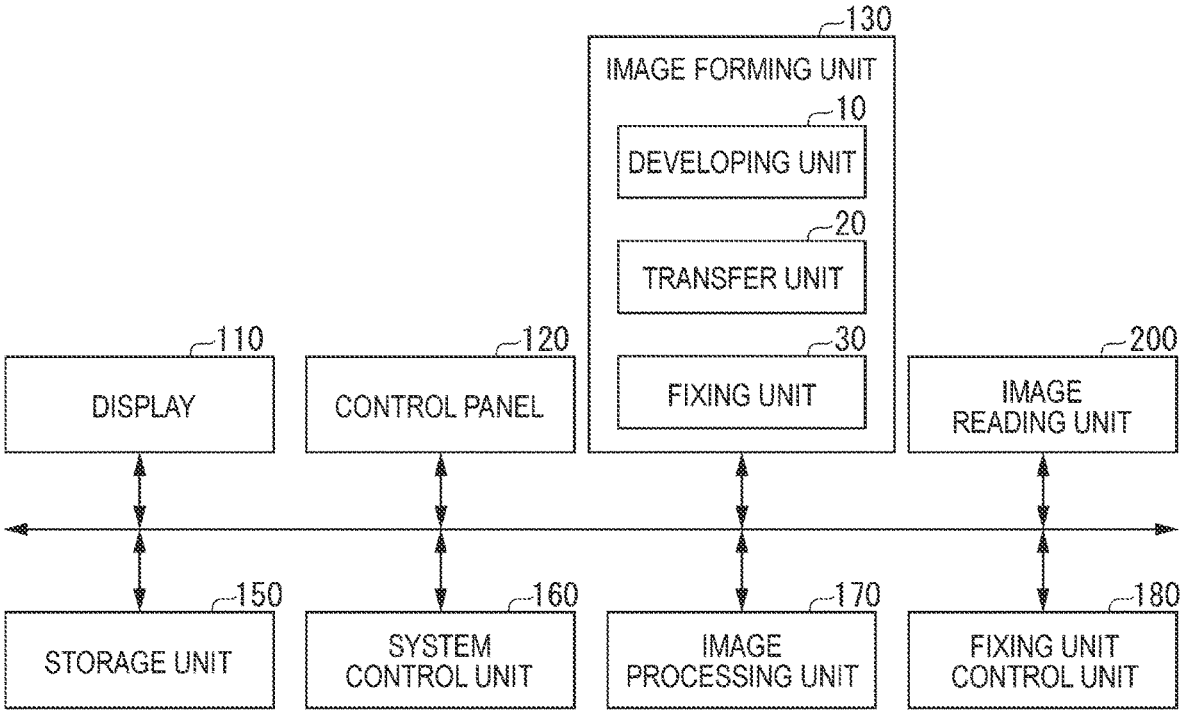
FIG. 5 is a view showing an example of a hardware configuration of an image forming apparatus.

FIG. 5 is a view showing an example of the hardware configuration of the image forming apparatus according to the embodiment. The image forming apparatus 100 includes the display 110, the control panel 120, the image forming unit 130, and the image reading unit 200. The image forming apparatus 100 further includes a storage unit 150, the system control unit 160, an image processing unit 170, and a fixing unit control unit (fixing controller) 180. Each unit is connected via a bus.

The display 110 and the control panel 120 are as described in FIG. 1. The image reading unit 200 reads the original document to generate image data as described in FIG. 1. In the image reading unit 200, a scanner unit includes a charge coupled device (CCD) sensor, a scanner lamp, a scanning optical system, a condenser lens, and the like.

The storage unit 150 is configured using a storage device such as a magnetic hard disk device or a semiconductor storage device. The storage unit 150 stores data necessary when the image forming apparatus 100 operates. The storage unit 150 may temporarily store image data formed in the image forming apparatus 100.

The system control unit 160 is configured using a processor such as a central processing unit (CPU) and a memory. The memory is, for example, a Read Only Memory (ROM) or a Random Access Memory (RAM). For example, the system control unit 160 reads and executes a program stored in advance in a memory or the like.

The system control unit 160 controls the operation of each device provided in the image forming apparatus 100. The system control unit 160 outputs a print job received from an external device and the image data output from the image reading unit 200 to the image processing unit 170.

The image processing unit 170 performs various data processing on the image data, and generates print data. The data processing includes, for example, processing such as color conversion, gamma correction, and halftone processing. The image processing unit 170 is, for example, an application specific integrated circuit (ASIC). The image processing unit 170 according to the embodiment determines whether or not each heating element 46 should be controlled to generate heat based on (a) whether or not other heating elements 46 are generating heat and (b) the image region. The details of the determination processing will be described later according to the flowcharts shown in FIGS. 6 and 7.

The fixing unit control unit 180 controls the heat generation of each heating element 46 of the fixing unit 30 based on the determination result of the presence or absence of heat generation of each heating element 46 output from the image processing unit 170. That is, the fixing unit control unit 180 controls the power supplied to each heating element 46. The power control may be realized by controlling the energization amount. Further, for example, the control of the energization amount may be realized by phase control or may be realized by wave number control.

The image forming unit 130 includes the developing unit 10, the transfer unit 20, and the fixing unit 30 as described with reference to FIG. 1. The image forming unit 130 transfers and fixes a developer image formed based on the print data output from the image processing unit 170. At this time, the fixing unit 30 fixes the developer image in accordance with the heating element 46 whose heat generation state is controlled by the fixing unit control unit 180.

According to the on-demand fixing method including the plurality of heating elements 46 described in FIGS. 1 to 5, as the quantity of the heating elements 46 increases, power saving performance can be improved. However, when the quantity of the heating elements 46 increases, the area of the substrate and the number of wirings increase, and variations in performance of each heating element 46 are more likely to occur. When the quantity of the heating element 46 is large, various problems arise.

The image forming apparatus 100 according to the embodiment controls the heat generation of a first heating element 46 based on (a) the presence or absence of heat generation of the second heating element 46 and (b) a maximum distance. The second heating element 46 is a heating element arranged adjacent to the first heating element 46. The maximum distance is the maximum distance from a first boundary to the end portion of the image region in the print region (i.e., a divided region) corresponding to the first heating element 46 in the main scanning direction. The first boundary indicates a boundary between the first heating element 46 and the second heating element 46.

That is, the image forming apparatus 100 controls the heating element 46 based on the presence/absence of heat generation of an adjacent heating element 46 and the arrangement of the image region in the divided region to be fixed. For example, the image forming apparatus 100 may control the target heating element 46 to not generate heat when the adjacent heating element 46 generates heat and the image region is located only near the boundary.

Accordingly, the image forming apparatus 100 can suppress the heat generation rate of each heating element 46 while avoiding the generation of unfixed developer. Accordingly, even when the quantity of the heating elements 46 is small, the heat generation rate of the plurality of heating elements 46 can be effectively reduced, and the power saving performance can be improved.

Figure 6:
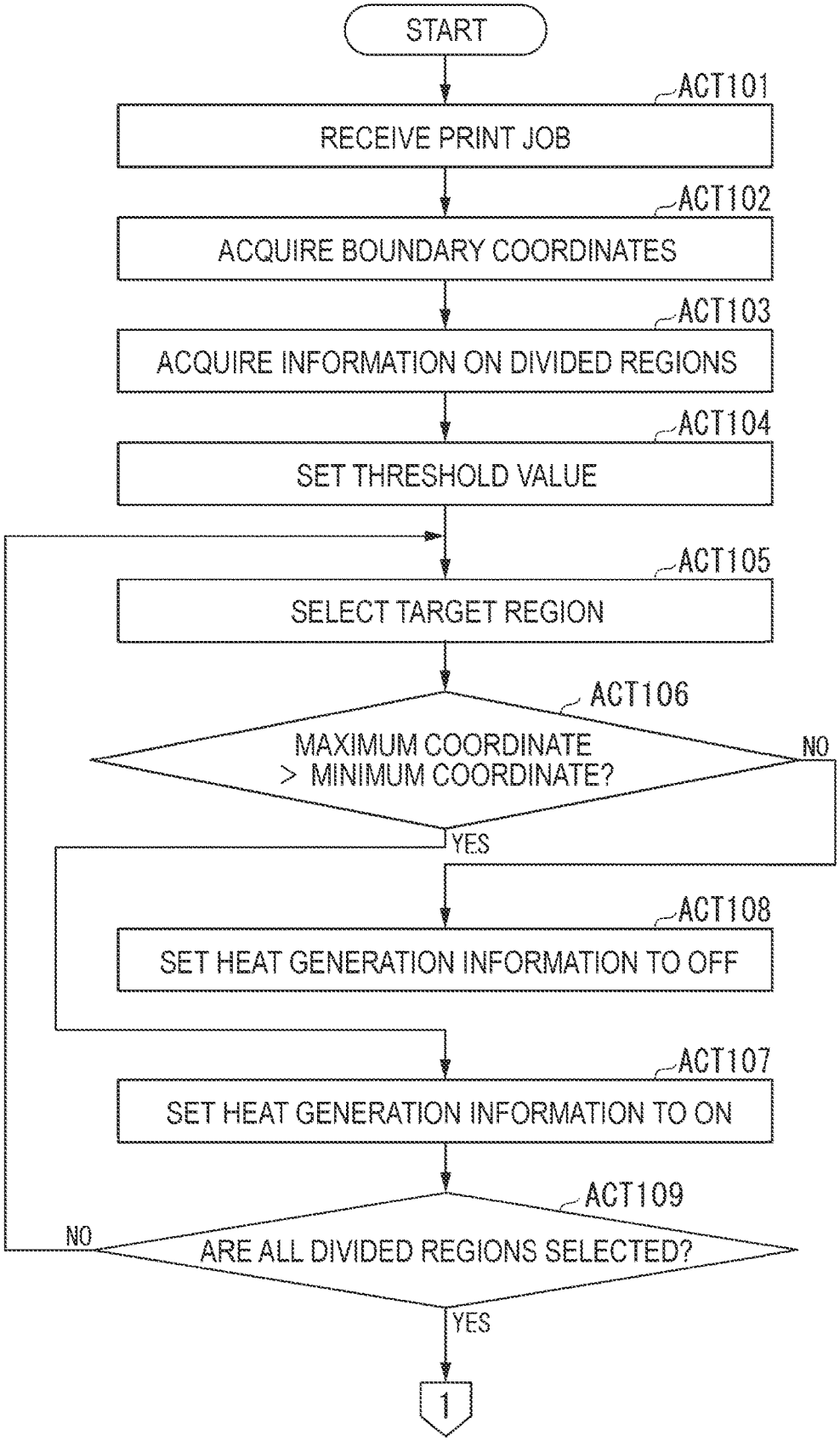
FIG. 6 is a first flowchart explaining a processing flow.
Figure 7:
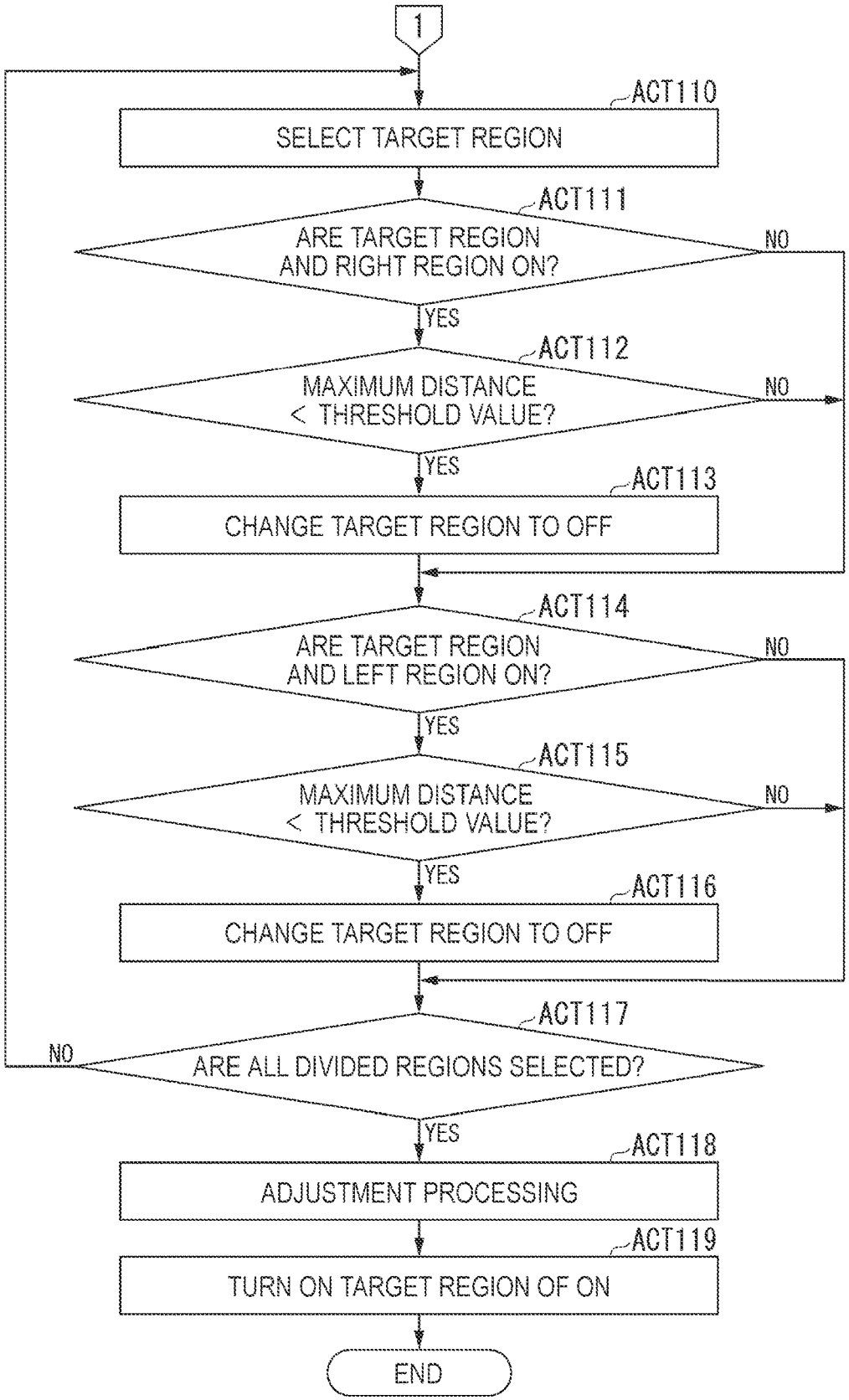
FIG. 7 is a second flowchart further explaining the processing flow of FIG. 6.

FIGS. 6 and 7 are flowcharts explaining the processing flow of the image forming apparatus 100 according to the embodiment.

The system control unit 160 of the image forming apparatus 100 receives a print job (ACT 101). The system control unit 160 may acquire the print job in response to an operation of a user on the control panel 120. In addition, the system control unit 160 may receive a print job from an external device via a network. The print job includes image data to be printed. The system control unit 160 outputs the image data to the image processing unit 170.

The image processing unit 170 acquires coordinate information (e.g., boundary coordinates) indicating boundaries between the plurality of heating elements 46 (ACT 102). The boundary coordinates are coordinates indicating boundaries among the plurality of heating elements 46 in the main scanning direction. Here, according to FIG. 8, the boundary coordinate information will be described.

Figure 8:
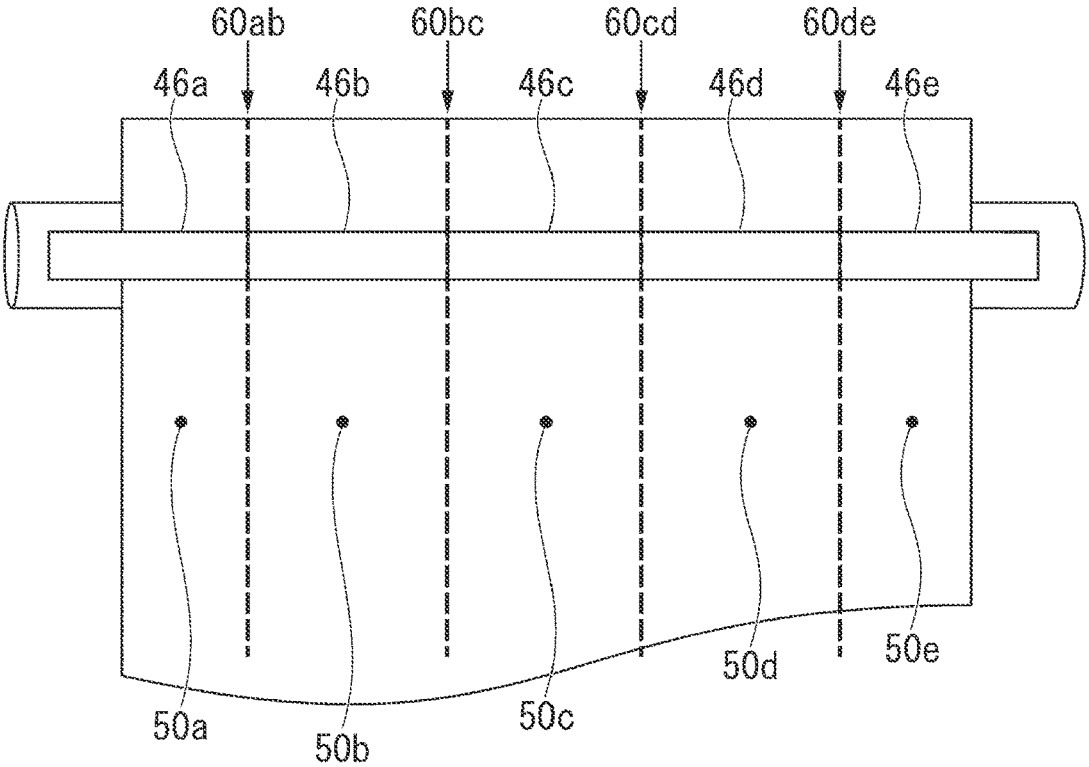
FIG. 8 is a view explaining an example of boundary coordinates among a plurality of heating elements.

FIG. 8 is a view explaining an example of boundary coordinates among the plurality of heating elements 46. The boundary coordinates in the example of FIG. 8 are coordinates 60*ab*, 60*bc*, 60*cd*, and 60*de*. Hereinafter, when the boundary coordinates 60*ab*, 60*bc*, 60*cd*, and 60*de* are not distinguished, the coordinates are also referred to as boundary coordinates 60.

The sheet is divided into a plurality of print regions or divided regions 50*a* to 50*e* according to target regions in which a corresponding one of the heating elements 46 fixes the developer (e.g., a first print region or divided region 50*a*, a second print region or divided region 50*b*, a third print region or divided region 50*c*, a fourth print region or divided region 50*d*, a fifth print region or divided region 50*e*). Hereinafter, when the divided regions 50*a* to 50*e* are not distinguished, the divided regions are also referred to as divided regions 50. The divided region 50*a* is a region in which the developer is fixed by the heating element 46*a*. Similarly, the divided region 50*b* is a region in which the developer is fixed by the heating element 46*b*. The same applies to other divided regions.

The boundary coordinates 60*ab*, 60*bc*, 60*cd*, and 60*de* are coordinates in the main scanning direction that indicate boundaries among the plurality of divided regions 50*a* to 50*e*. For example, the boundary coordinate 60*ab* is a coordinate of the boundary between the divided region 50*a* and the divided region 50*b*. Similarly, the boundary coordinate 60*bc* is the coordinate of the boundary between the divided region 50*b* and the divided region 50*c*. The same applies to the boundary coordinates 60*cd* and 60*de*.

Returning to the flowchart of FIG. 6, when the image processing unit 170 acquires the boundary coordinate 60, the process proceeds to processing of ACT 103. The image processing unit 170 acquires the minimum coordinate, the maximum coordinate, and density information for each divided region 50 (ACT 103).

The image processing unit 170 performs image processing on the image data and generates print data. The image processing includes, for example, color conversion, gamma correction, halftone processing, and the like. The image processing unit 170 performs image processing by pipeline processing in the main scanning direction and sub-scanning direction of each pixel of the image data. The image processing unit 170 acquires the minimum coordinate, the maximum coordinate, and the density information of each divided region 50 through image processing.

Figure 9:
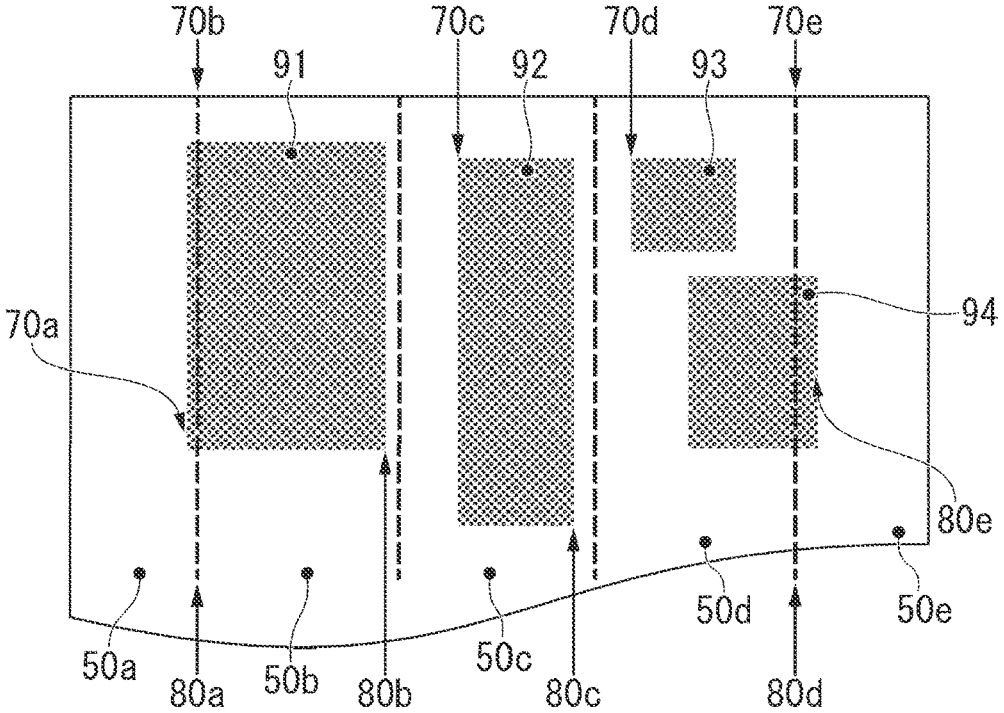
FIG. 9 is a view explaining an example of a minimum coordinate and a maximum coordinate of each of a plurality of divided regions.

FIG. 9 is a view explaining an example of the minimum coordinate and the maximum coordinate of each divided region. FIG. 9 illustrates minimum coordinates 70*a* to 70*e* and maximum coordinates 80*a* to 80*e* when images 91 to 94 are formed on the sheet. The minimum coordinates 70*a* to 70*e* may include, for example, a first minimum coordinate 70*a*, a second minimum coordinate 70*b*, a third minimum coordinate 70*c*, a fourth minimum coordinate 70*d*, and a fifth minimum coordinate 70*e*. The maximum coordinates 80*a* to 80*e* may include, for example, a first maximum coordinate 80*a*, a second maximum coordinate 80*b*, a third maximum coordinate 80*c*, a fourth maximum coordinate 80*d*, and a fifth maximum coordinate 80*e*. The images 91 to 94 may include, for example, a first image 91 formed in a first image region, a second image 92 formed in a second image region, a third image 93 formed in a third image region, and a fourth image 94 formed in a fourth image region. Hereinafter, when the minimum coordinates 70*a* to 70*e* are not distinguished, the minimum coordinates are also referred to as minimum coordinates 70. When the maximum coordinates 80*a* to 80*e* are not distinguished, the maximum coordinates are also referred to as maximum coordinates 80.

The image 91 is an image formed over a plurality of divided regions 50*a* and 50*b*. The images 92 and 93 are images formed in the divided regions 50*c* and 50*d*, respectively. The image 94 is an image formed over a plurality of divided regions 50*d* and 50*e*.

The minimum coordinate 70 is the minimum value of the coordinate in the main scanning direction of each pixel on which an image is formed in the divided region 50. For example, the minimum coordinate of the divided region 50*a* is the coordinate 70*a* of the left end of the image region in which the image 91 is formed. The minimum coordinate of the divided region 50*b* is the coordinate 70*b* at the left end of the image region in the divided region 50*b* in which the image 91 is formed. That is, the minimum coordinate 70*b* is the same value as the boundary coordinate 60*ab*.

Similarly, the minimum coordinate of the divided region 50*c* is the coordinate 70*c* at the left end of the image region in which the image 92 is formed. The minimum coordinate of the divided region 50*d* is the coordinate 70*d* at the left end of the image region in which the image 93 is formed. The minimum coordinate of the divided region 50*e* is the same value as the coordinate 70*e* at the left end of the image region in the divided region 50*e* in which the image 94 is formed, that is, the boundary coordinate 60*de*.

The maximum coordinate 80 is the maximum value of the coordinate in the main scanning direction of the pixel on which each image is formed in the divided region 50. For example, the maximum coordinate of the divided region 50*a* is a coordinate 80*a* at the right end of the image region in the divided region 50*a* where the image 91 is formed. That is, the maximum coordinate 80*a* is the same value as the boundary coordinate 60*ab*.

Similarly, the maximum coordinate of the divided region 50*b* is a coordinate 80*b* at the right end of the image region in which the image 91 is formed. The maximum coordinate of the divided region 50*c* is a coordinate 80*c* at the right end of the image region in which the image 92 is formed. The maximum coordinate of the divided region 50*d* is the same value as a coordinate 80*d* at the right end of the image region in the divided region 50*d* in which the image 94 is formed, that is, the boundary coordinate 60*de*. The maximum coordinate of the divided region 50*e* is a coordinate 80*e* at the right end of the image region in which the image 94 is formed.

Returning to the flowchart of FIG. 6, as described above, when the image processing unit 170 performs image processing, the minimum coordinate 70 and the maximum coordinate 80 of each divided region 50 described in FIG. 9 are acquired. At this time, the image processing unit 170 further acquires density information of each divided region 50.

The density information is a value indicating the maximum amount of the amount of the developer in each pixel included in the divided regions. For example, a pixel in which a developer with a plurality of colors (e.g., yellow (Y), magenta (M), cyan (C), black (K), and the like) is used and the degree of overlapping of the developer is high indicates that the amount of the developer is large. On the other hand, a pixel in which a monochromatic developer is used indicates that the amount of the developer is small. When a monochromatic developer is used, as a gradation value indicating the pixel value becomes larger, the amount of the developer becomes larger.

The image processing unit 170 acquires the amount of the developer for each pixel while scanning each pixel. For example, the image processing unit 170 can acquire the amount of the developer based on the gradation value of each color in each pixel. The image processing unit 170 acquires the amount of the developer of the pixel having the largest amount of the developer among each pixel included in the divided region 50 as the density information of the divided region 50.

Next, the image processing unit 170 sets a threshold value of each divided region 50 based on the density information of each divided region 50 (ACT 104). The threshold value set here is used in processing of ACT 112 and ACT 115 described later. The default value of the threshold value is 5 mm, for example.

Specifically, the image processing unit 170 acquires a threshold value of each divided region 50 based on the threshold value table stored in a memory or the like. The threshold value table has a correspondence relationship between density information and threshold values. In the threshold value table, as the density information increases, the threshold value increases, and as the density information decreases, the threshold value decreases. The image processing unit 170 refers to the threshold value table and acquires a threshold value corresponding to the density information for each divided region 50. The threshold value may be different for each divided region 50.

The image processing unit 170 selects a determination target divided region 50 (hereinafter referred to as a target region) from among the plurality of divided regions 50 (ACT 105). The image processing unit 170 determines whether or not the maximum coordinate 80 of the selected target region 50 is larger than the minimum coordinate 70 (ACT 106). When the maximum coordinate 80 is larger than the minimum coordinate 70 (YES in ACT 106), an image is formed in the target region 50. Therefore, the image processing unit 170 determines that the heat generation information of the target region 50 is "ON" (ACT 107). The image processing unit 170 stores the heat generation information as a determination result in the memory or the like.

On the other hand, when the maximum coordinate 80 is equal to or less than the minimum coordinate 70 (NO in ACT 106), no image is formed in the selected target region 50. When no image is formed in the target region 50, there is no developer image to which the heating element 46 is fixed. Therefore, the image processing unit 170 determines that the heat generation information of the target region 50 is "OFF" (ACT 108). The image processing unit 170 stores the heat generation information as a determination result in the memory or the like.

The image processing unit 170 determines whether or not all the divided regions 50 are selected (ACT 109). When all the divided regions 50 are not selected (NO in ACT 109), the image processing unit 170 returns the process to the processing of ACT 105 and selects another divided region 50. Then, the image processing unit 170 performs processing of ACT 106 to ACT 108 for another divided region 50.

On the other hand, when all the divided regions 50 are selected (YES in ACT 109), the image processing unit 170 corrects the heat generation information by the processing of ACT 110 to ACT 117. The processing after the processing of ACT 110 will be described according to the flowchart in FIG. 7. The image processing unit 170 selects the determination target divided region 50 among the plurality of divided regions 50 as the target region 50 (ACT 110).

The image processing unit 170 determines the heat generation information of the target region 50 and a divided region 50 adjacent to the right of the target region 50 (hereinafter, right adjacent region) (ACT 111). The image processing unit 170 determines whether or not the heat generation information of both of the target region 50 and the right adjacent region 50 based on the determination of the processing of ACT 106 to ACT 108 is "ON".

When the heat generation information of the target region and the right adjacent region is "ON" (YES in ACT 111), the image processing unit 170 performs the following determination based on the coordinate information of the target region 50. The image processing unit 170 determines whether the maximum distance based on the image region of the target region 50 is less than the threshold value (ACT 112).

Here, the maximum distance is calculated as a "boundary coordinate 60 between target region 50 and right adjacent region 50—minimum coordinate 70 of target region 50". That is, the maximum distance indicates the maximum value of the distance from (a) the boundary with the right adjacent region 50 to (b) the end portion of the image region in the target region 50 in the main scanning direction. In other words, the maximum distance is a distance to a pixel having the longest distance from the right boundary among the plurality of pixels included in the image region in the target region 50 in the main scanning direction.

Thus, the image processing unit 170 determines whether or not the image region of the target region 50 is included within a predetermined width range from the boundary coordinate 60 with the right adjacent region 50. When the determination result of the processing of ACT 112 is YES, the image region of the target region 50 is included within a predetermined width range from the boundary coordinate 60 with the right adjacent region 50. In other words, the image region of the target region 50 is located only near the boundary with the right adjacent region 50.

In this case, the image processing unit 170 determines that the target region 50 can be fixed by the heating element 46 in the right adjacent region 50. Accordingly, the image processing unit 170 changes the heat generation information of the target region 50 from "ON" to "OFF" (ACT 113). As described above, the image processing unit 170 sets the heat generation information to "OFF" when the heat generation information of the right adjacent region 50 is "ON" and the maximum distance from the right boundary is less than the threshold value.

On the other hand, when the processing of ACT 111 or ACT 112 is NO, the image processing unit 170 does not change the heat generation information of the target region 50. This indicates a case where the heating element 46 in the target region 50 needs to generate heat.

Figure 10:
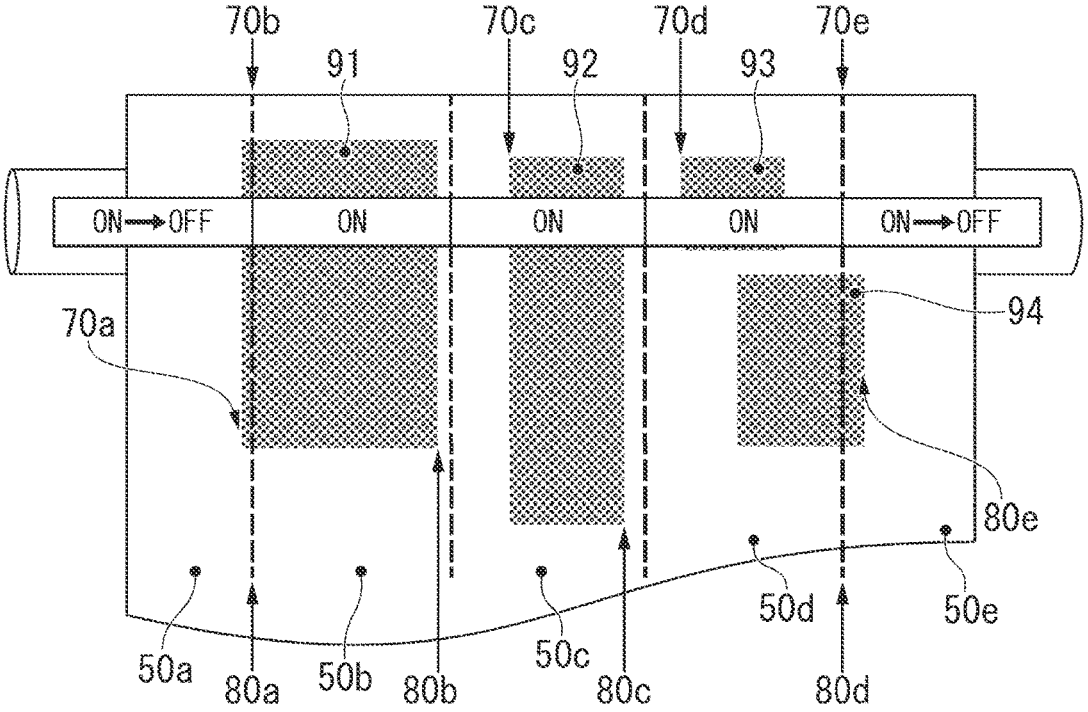
FIG. 10 is a view schematically explaining an example of correction processing of heat generation information.

FIG. 10 is a view schematically explaining an example of correction processing of heat generation information. A case where the target region 50 is the divided region 50*a* is exemplified. In the example of FIG. 10, the maximum coordinate 80*a* of the divided region 50*a* is larger than the minimum coordinate 70*a* (YES in ACT 106). For this reason, the heat generation information of the divided region 50*a* is set to "ON" (ACT 107).

In the example of FIG. 10, the heat generation information of both of the divided region 50*a* and the right adjacent region 50*b* are "ON" (YES in ACT 111). Further, the maximum distance "boundary coordinate 60*ab*—minimum coordinate 70*a* of target region 50" is less than the threshold value (YES in ACT 112). Therefore, the heat generation information of the target region 50*a* is corrected from "ON" to "OFF" (ACT 113).

In the example of FIG. 10, the image region of the target region 50*a* is included in a predetermined width range indicated by a threshold value from the boundary coordinate 60*ab* with the right adjacent region 50*b*. Thus, the heating element 46*a* is set so as not to generate heat. The image of the divided region 50*a* is fixed by heat transfer from the heating element 46*b* in the right adjacent region 50*b* to the substrate 41.

The processing routine returns to the flowchart of FIG. 7. Next, the image processing unit 170 determines the target region 50 and a divided region 50 adjacent to the left of the target region 50 (hereinafter, left adjacent region) (ACT 114). Specifically, the image processing unit 170 determines whether or not the heat generation information of both of the target region 50 and the left adjacent region 50 is "ON".

When the heat generation information of the target region and the left adjacent region is "ON" (YES in ACT 114), the image processing unit 170 performs the next determination based on the coordinate information of the target region 50. The image processing unit 170 determines whether or not the maximum distance based on the image region of the target region 50 is less than the threshold value (ACT 115).

The maximum distance is calculated as a "maximum coordinate 80 of target region 50—boundary coordinate 60 between target region 50 and left adjacent region 50". That is, the maximum distance indicates the maximum value of the distance from the boundary with the left adjacent region 50 at the end portion of the image region in the target region 50 in the main scanning direction. In other words, the maximum distance is a distance to the pixel having the longest distance from the left boundary among the plurality of pixels included in the main scanning direction in the image region in the target region 50. The threshold value is the same as the threshold value of the processing of ACT112.

Thus, the image processing unit 170 determines whether or not the image region of the target region 50 is included within a predetermined width range from the boundary coordinate 60 with the left adjacent region 50. When the determination result of processing ACT 115 is YES, the image region of the target region 50 is included within a predetermined width from the boundary coordinates 60 with the left adjacent region 50. In other words, the image region of the target region 50 is located only near the boundary with the left adjacent region 50.

In this case, the image processing unit 170 determines that the target region 50 can be fixed by the heating element 46 in the left adjacent region 50. Accordingly, the image processing unit 170 changes the heat generation information of the target region 50 from "ON" to "OFF" (ACT 116). As described above, in the image processing unit 170, when the heat generation information of the left adjacent region 50 is "ON" and the maximum distance from the left boundary is less than the threshold value, the heat generation information is changed to "OFF".

On the other hand, when the processing ACT 114 or ACT 115 is NO, the image processing unit 170 does not change the heat generation information of the target region 50. This indicates a case where the heating element 46 in the target region 50 needs to generate heat.

Here, according to FIG. 10, a case where the target region 50 is the divided region 50*e* will be described. In the example of FIG. 10, the maximum coordinate 80*e* of the divided region 50*e* is larger than the minimum coordinate 70*e* (ACT 106 YES). Therefore, the heat generation information of the divided region 50*e* is set to "ON" (ACT 107).

In the example of FIG. 10, the heat generation information of both of the divided region 50*e* and the left adjacent region 50*d* are "ON" (YES in ACT 114). In addition, the maximum distance "maximum coordinate 80*e* of target region 50*e*—boundary coordinate 60*de*" is less than the threshold value (YES in ACT 115). Therefore, the heat generation information of the target region 50*e* is corrected from "ON" to "OFF" (ACT 116).

In the example of FIG. 10, the image region of the target region 50*e* is included within a predetermined width range indicated by a threshold value from the boundary coordinate 60*de* with the left adjacent region 50*d*. Thus, the heating element 46*e* is set so as not to generate heat. The image of the divided region 50*e* is fixed by heat transfer from the heating element 46*d* in the left adjacent region 50*d* to the substrate 41.

Returning to the flowchart of FIG. 7, the image processing unit 170 determines whether or not all the divided regions 50 are selected (ACT 117). When all the divided regions 50 are not selected (NO in ACT 117), the image processing unit 170 returns the process to the processing ACT 110 and selects another divided region 50. Then, the image processing unit 170 performs processing ACT111 to ACT116 for another divided region 50.

On the other hand, when all the divided regions 50 are selected (YES in ACT 117), the image processing unit 170 performs heat generation information adjustment processing (ACT 118). The image processing unit 170 adjusts the heat generation information corrected by the correction processing ACT 110 to ACT 117. Specifically, when the heat generation information of both of the adjacent divided regions 50 is corrected from "ON" to "OFF", the image processing unit 170 returns the heat generation information of any one of adjacent divided regions to "ON".

More specifically, the image processing unit 170 holds the heat generation information of each divided region 50 before and after the correction processing. The image processing unit 170 compares the heat generation information of the adjacent divided regions 50 before and after the correction processing. When it is determined that the adjacent heat generation information is corrected to "OFF", for example, the image processing unit 170 returns the heat generation information of the right adjacent divided region 50 to "ON". Thus, the heat generation information of each heating element 46 is appropriately adjusted.

The image processing unit 170 stores the heat generation information of each divided region 50 after adjustment in the memory. The fixing unit control unit 180 controls the power of each heating element 46 according to the heat generation information stored in the memory (ACT 119). The fixing unit control unit 180 controls the power so that only the heating element 46 whose heat generation information is "ON" is turned on.

As described above, the threshold value used for the determination is set based on the maximum amount (e.g., density information) of the developer of each pixel included in the image region of the divided region 50 (ACT 104). For two images of a given width, the amount of heat required for fixing an image with a large amount of developer is relatively high, and the amount of heat required for fixing an image with a small amount of developer is relatively low.

Therefore, when the amount of the developer is large, the reference width (threshold) for determining whether or not an image is located within a predetermined width range from the boundary is set to be narrow. In this case, for example, a threshold value (for example, 4 mm) smaller than the default value is set. As the threshold value becomes smaller, the heat generation information becomes more difficult to be corrected to "OFF".

On the other hand, when the amount of the developer is small, the reference width (i.e., threshold value) for determining whether or not an image is located within a predetermined width range from the boundary is set to be wide. In this case, for example, a threshold value (6 mm) larger than the default value is set. As the threshold value becomes larger, the heat generation information is more easily corrected to "OFF".

In this manner, an appropriate threshold value is set in the image region of each divided region 50 based on the amount of the developer. Further, the threshold value used for controlling a certain heating element 46 may be different from the threshold value used for controlling another heating element 46. Accordingly, it is possible to flexibly reduce the heat generation rate of the heating element 46 while appropriately suppressing the generation of the unfixed developer according to the image of the divided region 50.

When the image processing unit 170 controls a certain heating element 46 not to generate heat, the heating temperature of the heating element 46 adjacent to the heating element 46 may be increased. Thus, even when the heating element 46 in the target region 50 is controlled so as not to generate heat, the generation of the unfixed developer in the target region 50 can be more appropriately suppressed.

As described above, the image forming apparatus 100 according to this embodiment includes the fixing unit 30 and the control units (170 and 180). In the fixing unit 30, the plurality of heating elements 46 that individually generate heat are arranged in the main scanning direction. The control unit controls the heat generation of the first heating element (e.g., a first heater) 46 based on the presence or absence of heat generation of the second heating element 46 arranged adjacent to the first heating element 46 and image arrangement. The image arrangement indicates the maximum distance from the first boundary to the end portion of the image region in which the image in the first print region corresponding to the first heating element 46 is formed in the main scanning direction. The first boundary is a boundary between the first heating element 46 and the second heating element 46 (e.g., a second heater). The second heating element 46 may be the right adjacent heating element 46 or the left adjacent heating element 46.

Accordingly, the image forming apparatus 100 can more flexibly control the presence or absence of heat generation of the heating element 46 based on the presence or absence of the heat generation of the adjacent heating elements 46 and the image arrangement in the print region. For example, when the adjacent heating elements 46 generate heat and it is determined that the image of the print region is located only near the boundary, the heat generation of the target heating element 46 can be suppressed. Thus, even when the quantity of the heating elements 46 is small, the heat generation rate of each heating element 46 can be reduced effectively. That is, it is possible to improve power savings while suppressing unfixed developer.

Modification Example

In the above-described embodiment, a case where the minimum coordinate 70 and the maximum coordinate 80 are acquired one by one for each divided region 50 is exemplified. In a modification example, a case where independent images are formed in each of left and right regions with the center of the target region 50 in the main scanning direction as a reference will be described. In such a case, the image processing unit 170 may acquire two minimum coordinates 70 and two maximum coordinates 80.

Figure 11:
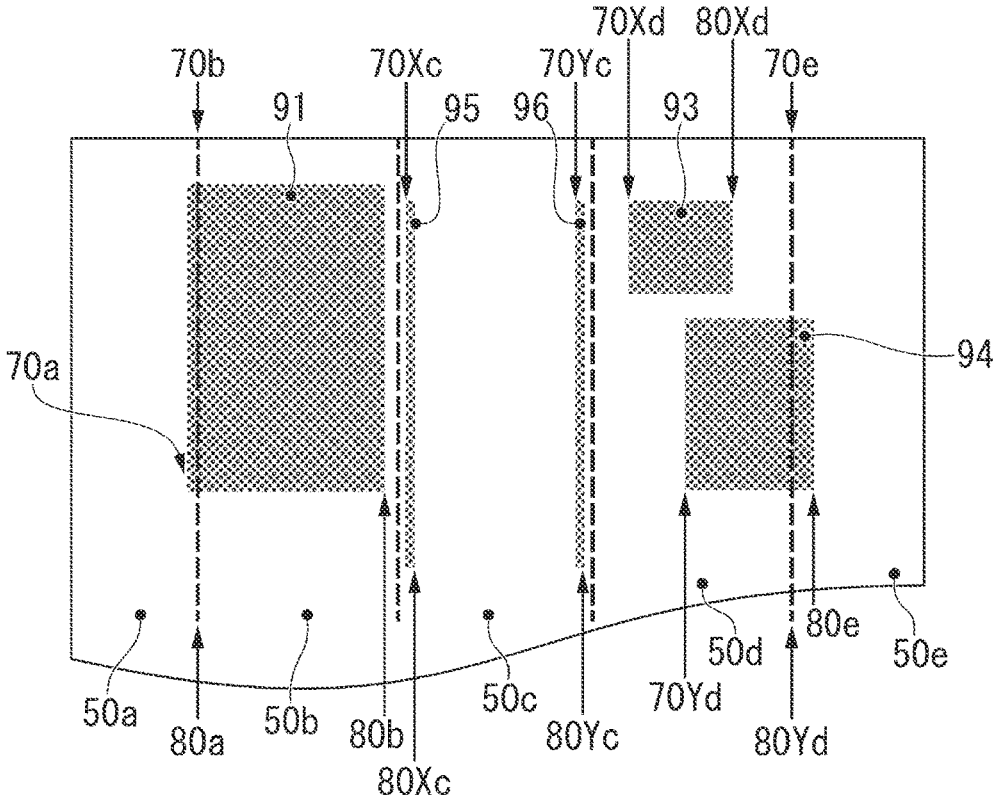
FIG. 11 is a view schematically explaining an example of the minimum coordinate and the maximum coordinate of each divided region in a modification example.

FIG. 11 is a view explaining an example of the minimum coordinate and the maximum coordinate of each divided region in the modified example. In FIG. 11, a case where images 91 and 93 to 96 are formed on a sheet is shown (e.g., a first image 91 formed in a first image region, a third image 93 formed in a third image region, a fourth image 94 formed in a fourth image region, a fifth image 95 formed in a fifth image region, a sixth image 96 formed in a sixth image region). The images 91, 93, and 94 are as described in the above embodiment.

The images 95 and 96 are images independent of each other. The images 95 and 96 are images formed in the divided region 50*c*, respectively. In the example in FIG. 11, the image 95 is located in a region near the left side with respect to the center of the target region 50 in the main scanning direction. In addition, the image 96 is located in a region near the left side with respect to the center of the target region 50 in the main scanning direction as a reference.

When the images are formed in the left and right regions with the center in the main scanning direction as a reference, each image may be located near the left and right boundaries. Therefore, the image processing unit 170 may hold two minimum coordinates 70 and two maximum coordinates 80. In this case, the image processing unit 170 acquires two minimum coordinates 70 (70Xc and 70Yc) for the divided region 50*c* and two minimum coordinates 70 (70Xd and 70Yd) for the divided region 50*d* in the processing ACT 103. Further, the image processing unit 170 acquires two maximum coordinates (80Xc and 80Yc) for the divided region 50*c* and two maximum coordinates (80Xd and 80Yd) for divided region 50*d*.

The first minimum coordinate 70Xc and the first maximum coordinate 80Xc are acquired based on the image 95 formed in the left region of the divided region 50. In the example of FIG. 11, the first minimum coordinate 70Xc is the left end coordinate of the image region in which the image 95 is formed. The first maximum coordinate 80Xc is the right end coordinate of the image region in which the image 95 is formed.

The second minimum coordinate 70Yc and the second maximum coordinate 80Yc are acquired based on the image 96 formed in the right region of the divided region 50. The second minimum coordinate 70Yc is the left end coordinate of the image region in which the image 96 is formed. The second maximum coordinate 80Yc is the right end coordinate of the image region in which the image 96 is formed.

In a case where an image is formed only in one of the left and right regions in the divided region 50, it is not always necessary to hold two minimum coordinates 70 and two maximum coordinates 80.

Figure 12:
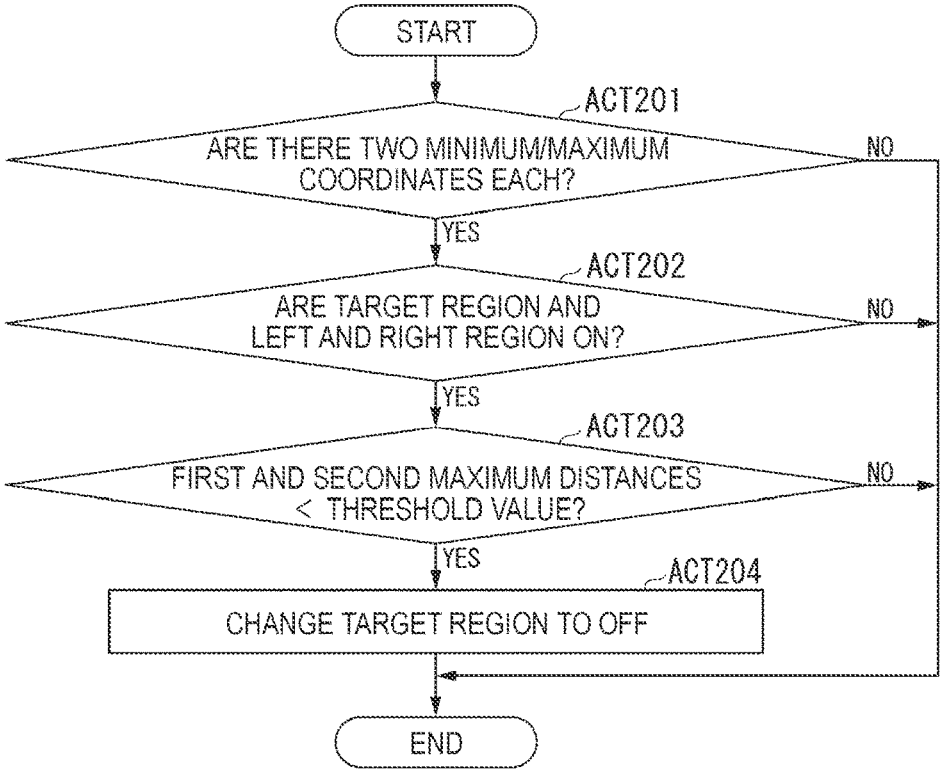
FIG. 12 is a flowchart explaining a processing flow.

FIG. 12 is a flowchart explaining the processing flow of the image forming apparatus 100 according to the modification example. In the correction processing in the modification example, in addition to the processing of ACT 111 to ACT 116 described in FIG. 7, the processing of ACT 201 to ACT 204 shown in FIG. 12 is performed. In the modification example, the image processing unit 170 performs processing of ACT 201 to ACT 204 between the processing of ACT 116 and the processing of ACT 117.

After the processing of ACT 116, the image processing unit 170 determines whether or not the divided region 50 holds two minimum coordinates 70 and two maximum coordinates 80 (ACT 201). When two minimum coordinates 70 and two maximum coordinates 80 are held (YES in ACT 201), the image processing unit 170 performs determination processing in the processing of ACT 202. The image processing unit 170 determines whether or not the heat generation information of the target region 50, the left adjacent region 50, and the right adjacent region 50 is "ON" (ACT 202). When the heat generation information of the three regions is "ON" (YES in ACT 202), the image processing unit 170 performs the following determination processing. That is, the image processing unit 170 determines whether or not a first maximum distance and a second maximum distance of the target region 50 are less than the threshold value (ACT 203).

The first maximum distance is the maximum distance from (a) the boundary between the target region 50 and the left adjacent region 50 to (b) the image 95 near the left side. The first maximum distance is a value "first maximum coordinate 80Xc of target region 50—boundary coordinate 60 between target region 50 and left adjacent region 50".

The second maximum distance is the maximum distance from (a) the boundary between the target region 50 and the right adjacent region 50 to (b) the image 96 near the right side. The second maximum distance is a value of "boundary coordinate 60 between target region 50 and right adjacent region 50—second minimum coordinate 70Yc of target region 50".

When both values are less than the threshold value (YES in ACT 203), each image region of the target region 50 is located only near the left and right boundaries. Therefore, the image processing unit 170 corrects the heat generation information of the target region 50 from "ON" to "OFF" (ACT 204). In this manner, the image processing unit 170 controls the heating element 46 in the target region 50 not to generate heat when the first maximum distance and the second maximum distance are less than the threshold value. On the other hand, when any of the processing of ACT201 to ACT203 is NO, the image processing unit 170 does not change the heat generation information of the target region 50. The subsequent processing transits to the processing of ACT 117 shown in FIG. 7.

Figure 13:
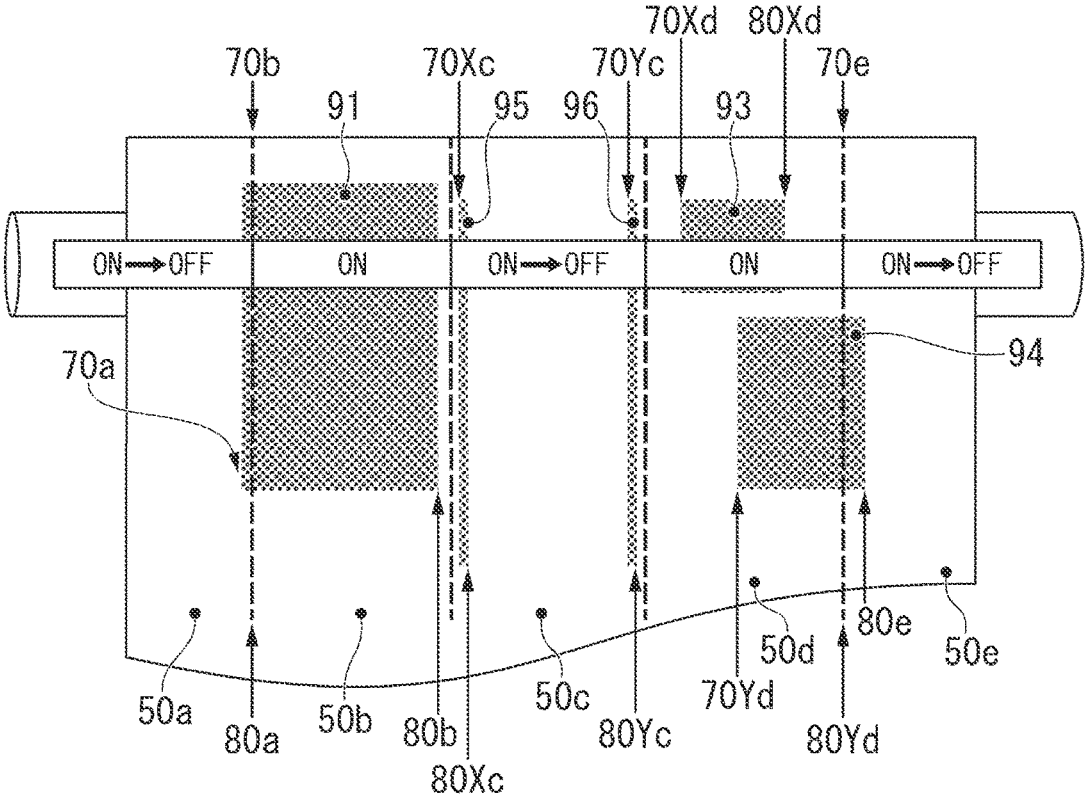
FIG. 13 is a view schematically explaining an example of correction processing of heat generation information.

FIG. 13 is a view schematically explaining an example of the heat generation information correction processing according to the modification. Here, a case where the target region 50 is the divided region 50*c* is exemplified. In the example in FIG. 13, the heat generation information of the three divided regions 50*b*, 50*c*, and 50*d* is set to "ON" as a result of the processing of ACT 111 to ACT 116.

Since the heat generation information of the three divided regions 50 is "ON", the image processing unit 170 compares the first maximum distance and the second maximum distance with the threshold value. The first maximum distance is a value "first maximum coordinate 80Xc of target region 50*c*—boundary coordinate 60*bc*". The second maximum distance is a value "boundary coordinates 60*cd*—second minimum coordinates 70Yc of the target region 50*c*".

In the example of FIG. 13, the first maximum distance and the second maximum distance are less than the threshold value. Therefore, the heat generation information of the target region 50*c* is corrected from "ON" to "OFF". That is, it is determined that the images 95 and 96 are located only near the boundary. For this reason, when the heat generation information of the adjacent divided regions 50*b* and 50*d* is "ON", the heating element 46*c* is set so as not to generate heat. In this case, the images 95 and 96 are fixed by heat transfer from the heating elements 46*b* and 46*d* in the left adjacent region 50*b* and the right adjacent region 50*d* to the substrate 41.

As described above, according to the modification example, two minimum coordinates 70 and two maximum coordinates 80 are held. Thus, the number of the heating elements 46 controlled not to generate heat can be further increased. Accordingly, even when the number of division of the heater is small, the heat generation rate of each heating element 46 can be further reduced.

The same applies to the divided region 50*d*. In this case, the first maximum distance is the maximum distance from the left boundary 60*cd* to the first maximum coordinate 80Xd based on the image 93. The second maximum distance is the maximum distance from the boundary 60*de* to the second minimum coordinate 70Yd based on the image 94. In this case, any maximum distance is equal to or greater than the threshold value. Therefore, the heat generation information in the divided region 50*d* remains "ON" and is not corrected.

In the examples in FIGS. 11 and 13, a case where two images are formed in the target region 50 is exemplified. However, the present disclosure can also be applied to a case where three or more images are formed in the target region 50.

In this case, the image processing unit 170 selects two images located near the center of the target region 50 in the main scanning direction from the three or more images. Then, the image processing unit 170 acquires the first maximum distance and the second maximum distance based on the positional relationship between the two selected images. Thus, it is possible to efficiently determine whether or not the image is located only near the boundary.

In the above-described embodiment, a case where the processing of the image processing unit 170 and the fixing unit control unit 180 is realized by hardware is exemplified. However, the present embodiment is not limited to this example. The processing of the image processing unit 170 and the fixing unit control unit 180 may be realized by software. The CPU implements processing of the image processing unit 170 and the fixing unit control unit 180 by executing a program stored in the memory.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming device configured to form an image on a sheet;

a first heater configured to generate heat to heat a first print region of the sheet;

a second heater configured to generate heat to heat a second print region of the sheet, the second heater being adjacent the first heater in a main scanning direction; and a controller configured to control the first heater to generate heat and the second heater to not generate heat based on a distance in the main scanning direction from (a) an end of a region of the image that overlaps the second heater to (b) a boundary between the first heater and the second heater in a situation where the region overlaps the boundary.

2. The image forming apparatus of claim 1, wherein:

the region of the image contains a plurality of pixels of the image; and the distance is between (a) a pixel of the plurality of pixels that is located farthest from the boundary and (b) the boundary.

3. The image forming apparatus of claim 1, wherein the controller is configured to control the second heater to not generate heat in a situation where the image is absent from the second print region.

4. The image forming apparatus of claim 1, further comprising:

a film that overlaps the first heater and the second heater.

5. The image forming apparatus of claim 4, further comprising:

a pressure roller configured to press against the film to convey the sheet in a conveyance direction.

6. The image forming apparatus of claim 1, wherein the controller is configured to:

control the first heater to not generate heat while controlling the second heater to generate heat.

7. The image forming apparatus of claim 6, wherein the controller is configured to:

increase a heating temperature of the second heater while controlling the first heater to not generate heat.

8. The image forming apparatus of claim 1, wherein the controller is configured to control the first heater to not generate heat in a situation where the distance is less than a threshold value.

9. The image forming apparatus of claim 8, wherein the threshold value is set based on an amount of a developer.

10. The image forming apparatus of claim 1, further comprising:

a third heater configured to generate heat to heat a third print region of the sheet, the third heater being adjacent the second heater in the main scanning direction.

11. The image forming apparatus of claim 10, wherein the controller is configured to:

control the third heater to not generate heat in a situation where the image is absent from the third print region.

12. The image forming apparatus of claim 10, wherein the distance is a first distance, the region of the image is a first region, and the controller is configured to:

control the second heater to generate heat and the third heater not to generate heat based on a second distance in the main scanning direction from (a) an end of a second region of the image that overlaps the third heater to (b) a boundary between the second heater and the third heater in a situation where the second region overlaps the boundary between the second heater and the third heater.

13. The image forming apparatus of claim 10, wherein the distance is a first distance, the region of the image is a first region, and the controller is configured to:

control the second heater to generate heat and the third heater not to generate heat based on a second distance in the main scanning direction from (a) a first end of a second region of the image that overlaps the third heater to (b) a boundary between the second heater and the third heater in a situation where:

the second region overlaps the boundary between the second heater and the third heater; and a second end of the second region of the image overlaps the second heater.

14. The image forming apparatus of claim 10, further comprising:

a fourth heater configured to generate heat to heat a fourth print region of the sheet, the fourth heater being adjacent the first heater in the main scanning direction.

15. The image forming apparatus of claim 14, wherein the controller is configured to:

control the fourth heater to not generate heat in a situation where the image is absent from the fourth print region.

16. The image forming apparatus of claim 14, wherein the distance is a first distance, the region of the image is a first region, and the controller is configured to:

control the first heater to generate heat and the fourth heater not to generate heat based on a second distance in the main scanning direction from (a) an end of a second region of the image that overlaps the fourth heater to (b) a boundary between the first heater and the fourth heater in a situation where the second region overlaps the boundary between the first heater and the fourth heater.

17. The image forming apparatus of claim 14, wherein the distance is a first distance, the region of the image is a first region, and the controller is configured to:

control the first heater to generate heat and the fourth heater not to generate heat based on a second distance in the main scanning direction from (a) a first end of a second region of the image that overlaps the fourth heater to (b) a boundary between the first heater and the fourth heater in a situation where:

the second region overlaps the boundary between the first heater and the fourth heater; and a second end of the second region of the image overlaps the first heater.

18. The image forming apparatus of claim 14, wherein the controller is configured to control:

the second heater and the fourth heater to generate heat; and the first heater to not generate heat.

19. A method for controlling an image forming apparatus including a first heater that heats a first print region of a sheet and a second heater that heats a second print region of a sheet, the second heater being adjacent the first heater in a main scanning direction, the method comprising:

determining a distance in the main scanning direction from (a) an end of a region of the image that overlaps the second heater to (b) a boundary between the first heater and the second heater; and controlling the first heater to heat the first print region and the second heater to not heat the second print region based on the distance in a situation where the region of the image overlaps the boundary.

20. A storage medium configured to store a program for controlling an image forming apparatus including a first heater that heats a first print region of a sheet and a second heater that heats a second print region of a sheet, the second heater being adjacent the first heater in a main scanning direction, the program causing a control unit to perform operations comprising:

determining a distance in the main scanning direction from (a) an end of a region of the image that overlaps the second heater to (b) a boundary between the first heater and the second heater; and controlling the first heater to heat the first print region and the second heater to not heat the second print region based on the distance in a situation where the region of the image overlaps the boundary.

* * * * *